US009103241B2

(12) United States Patent
Hayashi et al.

(10) Patent No.: US 9,103,241 B2
(45) Date of Patent: Aug. 11, 2015

(54) VALVE TIMING CONTROLLER

(71) Applicant: DENSO CORPORATION, Kariya, Aichi-pref. (JP)

(72) Inventors: Masashi Hayashi, Okazaki (JP); Tomonori Suzuki, Kariya (JP); Kenshin Yokose, Nagoya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/041,343

(22) Filed: Sep. 30, 2013

(65) Prior Publication Data

US 2014/0090613 A1 Apr. 3, 2014

(30) Foreign Application Priority Data

Sep. 28, 2012 (JP) ..... 2012-216506
Apr. 4, 2013 (JP) ..... 2013-078746
Jun. 10, 2013 (JP) ..... 2013-121784

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34433* (2013.01); *F01L 2001/34469* (2013.01); *F01L 2101/00* (2013.01); *F01L 2820/031* (2013.01)

(58) Field of Classification Search
CPC .. F01L 1/344; F01L 2001/3445; F01L 1/3442
USPC ..... 123/90.15, 90.17
See application file for complete search history.

(56) References Cited

U.S. PATENT DOCUMENTS 6,487,996 B1 * 12/2002 Motz et al. ..... 123/90.17
6,805,080 B2 10/2004 Golovatai-Schmidt et al.
2008/0236528 A1 * 10/2008 Hertrich et al. ..... 123/90.17
2014/0090612 A1 * 4/2014 Hayashi et al. ..... 123/90.15
2014/0144399 A1 * 5/2014 Hayashi et al. ..... 123/90.15

FOREIGN PATENT DOCUMENTS

JP 2002-295207 10/2002

OTHER PUBLICATIONS

Hayashi et al., U.S. Appl. No. 14/041,297, filed Sep. 30, 2013.

* cited by examiner

*Primary Examiner* — Thomas Denion
*Assistant Examiner* — Daniel Bernstein
(74) *Attorney, Agent, or Firm* — Nixon & Vanderhye P.C.

(57) ABSTRACT

A valve timing controller includes a housing, a vane rotor, and a stopper pin. The stopper pin regulates a relative rotation position of the vane rotor relative to the housing. A boss part of the vane rotor has a plurality of metal plates layered with each other in an axial direction. At least one metal plate of the plurality of metal plates has a hole in which the stopper pin is inserted, and a nail projected from an inner wall of the hole toward the stopper pin so as to hold the stopper pin.

9 Claims, 15 Drawing Sheets

VALVE TIMING CONTROLLER

CROSS REFERENCE TO RELATED APPLICATION

This application is based on Japanese Patent Application No. 2012-216506 filed on Sep. 28, 2012, Japanese Patent Application No. 2013-78746 filed on Apr. 4, 2013, and Japanese Patent Application No. 2013-121784 filed on Jun. 10, 2013, the disclosures of which are incorporated herein by reference in their entirety.

TECHNICAL FIELD

The present disclosure relates to a valve timing controller.

BACKGROUND

JP-2003-120231A (corresponding to U.S. Pat. No. 6,805,080 B2) describes a valve timing controller which controls opening and closing timing of a valve driven by a driven shaft by changing a rotation phase of the driven shaft to a driving shaft of an internal combustion engine. The opening and closing timing is changed by changing a pressure of oil in the advance chamber and the retard chamber in the housing so as to rotate the vane rotor relative to the housing. The relative rotation of the vane rotor to the housing is limited when the vane part of the vane rotor contacts the partition part of the housing.

When the oil pressure is comparatively low in each oil pressure chamber, for example, immediately after the engine start, the vane rotor may have an abnormal movement due to variation torque transmitted from the camshaft to the vane rotor. At this time, the vane part of the vane rotor may collide with the partition part of the housing, so the vane rotor and the housing may be damaged.

SUMMARY

It is an object of the present disclosure to provide a valve timing controller in which a vane rotor and a housing are restricted from being damaged.

According to an example of the present disclosure, a valve timing controller which controls opening-and-closing timing of a valve driven by a driven shaft by changing a rotation phase of the driven shaft to a driving shaft of an internal combustion engine includes a housing, a vane rotor and a stopper pin. The housing is rotatable integrally with one of the driving shaft and the driven shaft, and has a first stopper surface and a second stopper surface. The vane rotor includes a boss part which is rotatable integrally with the other of the driving shaft and the driven shaft inside the housing, and a vane part which divides a space partitioned by the housing and the boss part into an advance chamber and a retard chamber. The vane rotor is relatively rotated relative to the housing on an advance side or a retard side according to a pressure of oil in the advance chamber and the retard chamber. The stopper pin is projected from the boss part of the vane rotor to the housing in an axial direction. The stopper pin regulates a relative rotation position of the vane rotor to the housing to a maximum advance position by contacting the first stopper surface of the housing. The stopper pin regulates the relative rotation position of the vane rotor to the housing to a maximum retard position by contacting the second stopper surface of the housing. The boss part of the vane rotor has a plurality of metal plates layered with each other in the axial direction. At least one metal plate of the plurality of metal plates has a hole in which the stopper pin is inserted, and a nail projected from an inner wall of the hole toward the stopper pin so as to hold the stopper pin.

The valve timing controller includes the stopper pin projected from the boss part of the vane rotor to the housing in the axial direction. The stopper pin regulates the relative rotation position of the vane rotor relative to the housing to the maximum advance position, by contacting the first stopper surface of the housing. Moreover, the relative rotation position of the vane rotor relative to the housing is regulated to the maximum retard position by contacting the second stopper surface of the housing.

The boss part of the vane rotor includes plural metal plates layered in the axial direction. At least one of the metal plates has a hole in which the stopper pin is inserted, and a nail projected from the inner wall of the hole toward the stopper pin so as to hold the stopper pin.

The impulse force produced when the stopper pin collides with the stopper surface is reduced because the nail is elastically deformed. That is, the nail corresponds to an impact absorbing portion. Accordingly, the impulse force applied to the vane rotor and the housing can be reduced, and the vane rotor and the housing are restricted from being damaged.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
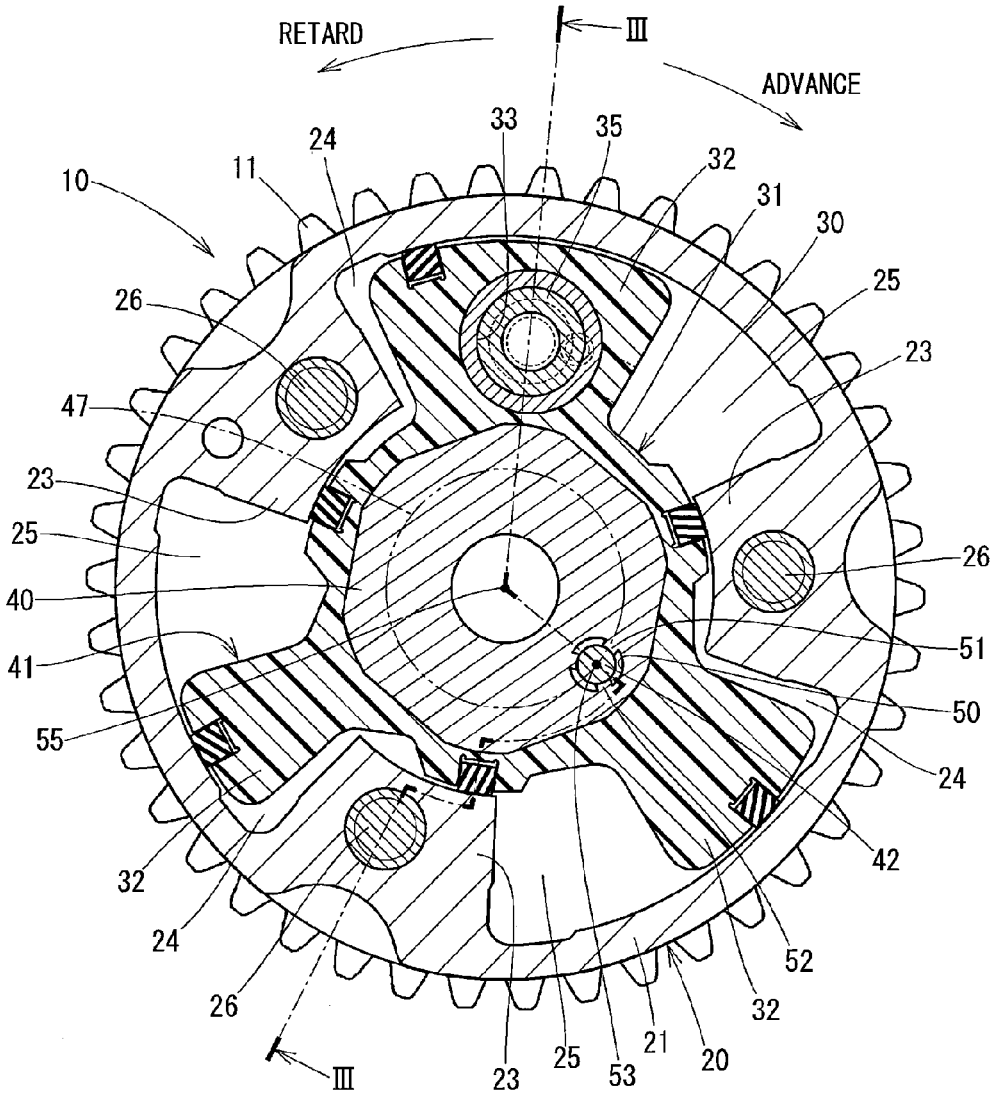
FIG. 1 is a cross-sectional view illustrating a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 2:
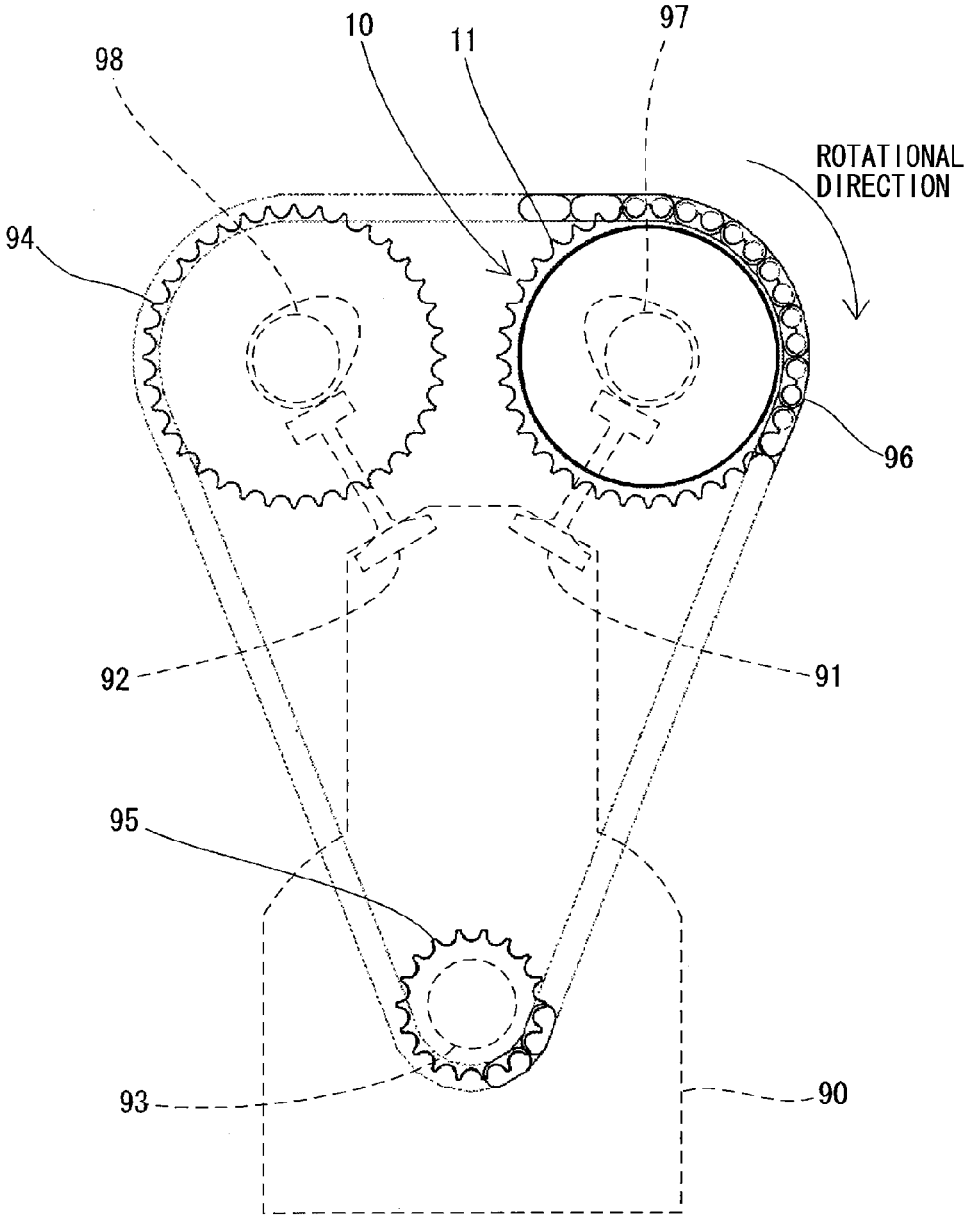
FIG. 2 is a schematic view illustrating a valve timing control system having the valve timing controller of FIG. 1.

A valve timing controller 10 according to a first embodiment is shown in FIG. 1, and controls opening-and-closing timing of an intake valve 91 of an internal combustion engine 90 shown in FIG. 2. As shown in FIG. 2, rotation of a crankshaft 93 corresponding to a driving shaft of the engine 90 is transmitted to camshafts 97, 98 through a chain 96 wound around sprockets 11, 94, 95. The camshaft 97 may correspond to a driven shaft which opens and closes the intake valve 91, and the camshaft 98 may correspond to a driven shaft which opens and closes an exhaust valve 92.

The valve timing controller 10 advances opening-and-closing timing of the intake valve 91 by relatively rotating the camshaft 97 in a rotational direction relative to the sprocket 11 which integrally rotates with the crankshaft 93. Thus, the opening-and-closing timing of the intake valve 91 is made early.

Moreover, the valve timing controller 10 retards opening-and-closing timing of the intake valve 91 by relatively rotating the camshaft 97 in an opposite direction opposite from the rotational direction relative to the sprocket 11. Thus, the opening-and-closing timing of the intake valve 91 is made late.

Figure 3:
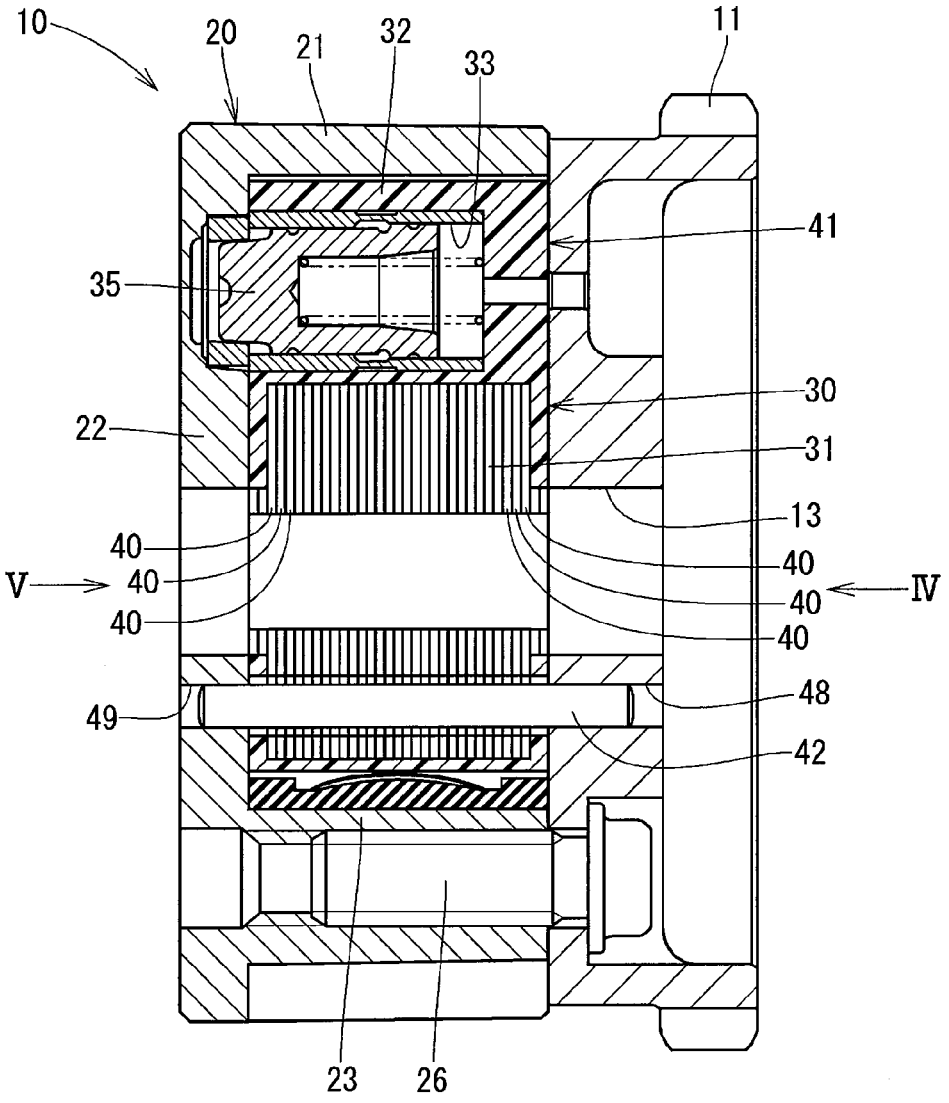
FIG. 3 is a cross-sectional view taken along a line in FIG. 1.

As shown in FIG. 1 and FIG. 3, the valve timing controller 10 is equipped with the sprocket 11, a cup 20, a vane rotor 30, and a lock pin 35. The cup 20 has a pipe part 21, a bottom part 22 and plural partition parts 23. The pipe part 21 is coaxially arranged with the camshaft. The bottom part 22 is placed to an axial end of the pipe part 21. The plural partition parts 23 extend from the pipe part 21 inward in the radial direction so that the inside of the pipe part 21 is divided into plural pressure chambers.

The sprocket 11 is arranged to the opposite side of the bottom part 22 with respect to the pipe part 21, and is fixed to the cup 20 by a bolt 26. The sprocket 11 has a through hole 13, and the camshaft is inserted in the through hole 13. The sprocket 11 and the cup 20 are able to rotate integrally with the crankshaft, and may correspond to a housing.

The vane rotor 30 has a boss part 31 and plural vane parts 32. The boss part 31 has a cylindrical shape, and is arranged on an inner side of the partition part 23 of the cup 20 in the radial direction. The plural vane parts 32 extend from the boss part 31 outward in the radial direction so that the pressure chamber defined by the cup 20 and the boss part 31 is divided into an advance chamber 24 and a retard chamber 25. The boss part 31 is fixed to the camshaft, for example, by a bolt, and is able to rotate integrally with the camshaft.

The vane rotor 30 has an advance oil passage (not shown) communicating with the advance chamber 24 and a retard oil passage (not shown) communicating with the retard chamber 25. Operation oil is supplied to the advance chamber 24 and the retard chamber 25 via the advance oil passage and the retard oil passage, respectively, from an external oil supply source. The vane rotor 30 is rotated relative to the housing 20 on advance side or retard side according to a pressure of the operation oil in the advance chamber 24 and the retard chamber 25.

One of the plural vane parts 32 has a hole 33. The lock pin 35 is supported in the hole 33 and is slidable in the hole 33 in the axial direction. The lock pin 35 is fitted to or separated from the bottom part 22 of the cup 20. When the lock pin 35 is inserted in the bottom part 22, the vane rotor 30 is locked not to have a relative rotation with respect to the cup 20.

When a rotation phase is located on a retard side from a target phase, operation oil is supplied to the advance chamber 24, and operation oil is discharged from the retard chamber 25. Thereby, the vane rotor 30 is rotated relative to the housing 20 on the advance side.

When a rotation phase is located on an advance side from a target phase, operation oil is supplied to the retard chamber 25, and operation oil is discharged from the advance chamber 24. Thereby, the vane rotor 30 is rotated relative to the housing 20 on the retard side.

When a rotation phase is in agreement with a target phase, the advance chamber 24 and the retard chamber 25 are closed, and the rotation phase is maintained.

As shown in FIG. 1 and FIG. 3, the vane rotor 30 has plural metal plates 40 layered with each other in the axial direction and a resin component 41 covering the radially outer side of the metal plates 40. The metal plates 40 may correspond to a center section of the boss part 31 of the vane rotor 30. The resin component 41 may correspond to a perimeter section of the boss part 31 of the vane rotor 30 and the vane part 32 of the vane rotor 30.

Figure 4:
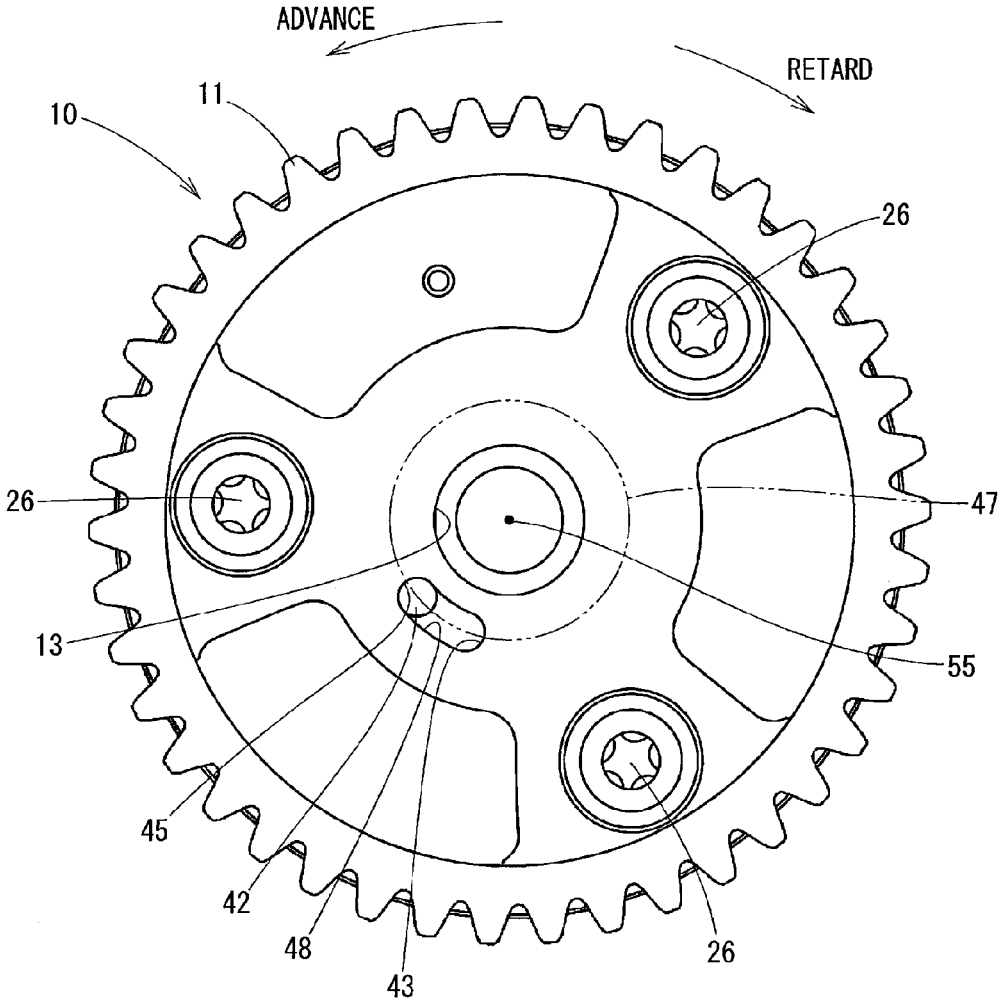
FIG. 4 is a side view illustrating the valve timing controller of FIG. 3 seen from an arrow direction IV.
Figure 5:
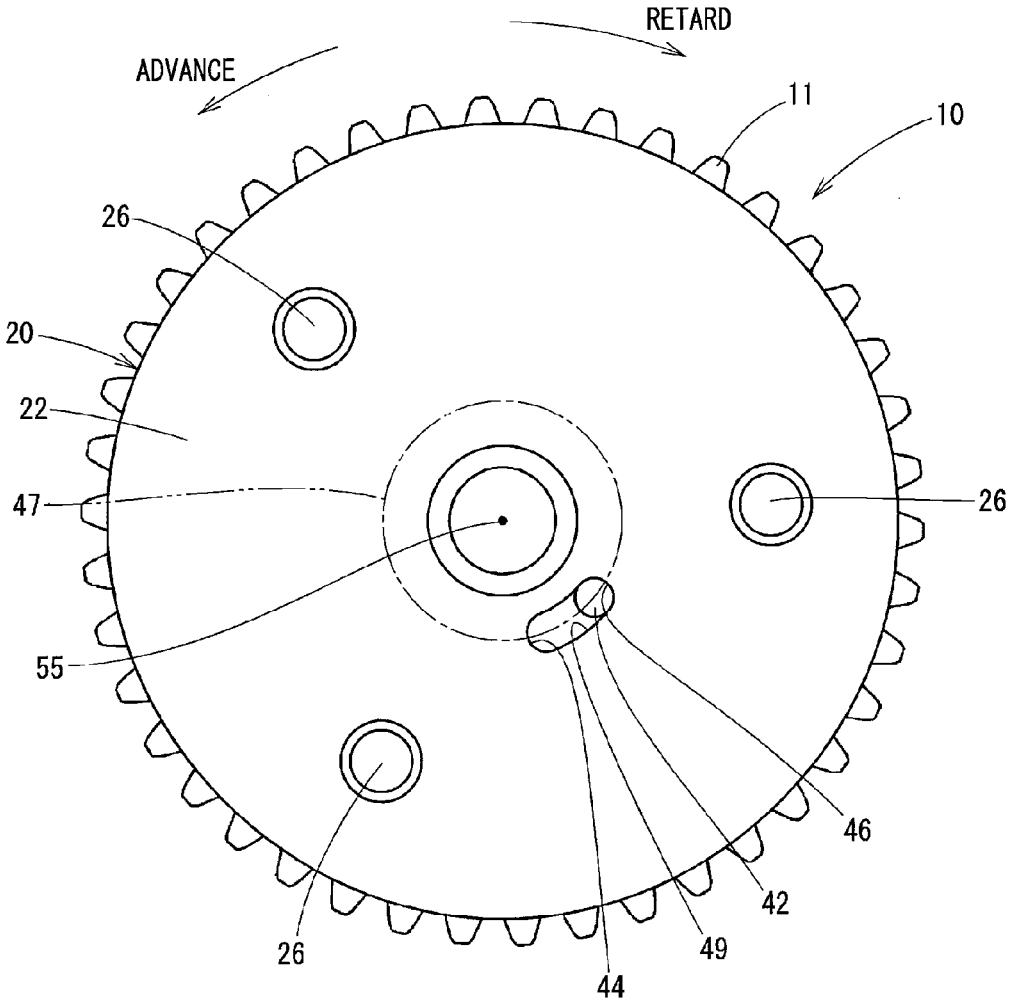
FIG. 5 is a side view illustrating the valve timing controller of FIG. 3 seen from an arrow direction V.

A stopper pin 42 is disposed in the boss part 31 of the vane rotor 30. The stopper pin 42 penetrates the boss part 31 of the vane rotor 30 in the axial direction. As shown in FIG. 3, a first axial end part of the stopper pin 42 is projected into the sprocket 11, and a second axial end part of the stopper pin 42 is projected into the bottom part 22 of the cup 20. In the first embodiment, the number of the stopper pin 42 is, for example, one. As shown in FIG. 4 and FIG. 5, when the stopper pin 42 contacts the first stopper surface 43, 44, the relative rotation position of the vane rotor 30 to the cup 20 is regulated to the maximum advance position. When the stopper pin 42 contacts the second stopper surface 45, 46, the relative rotation position of the vane rotor 30 to the cup 20 is regulated to the maximum retard position.

As shown in FIG. 4, the sprocket 11 has a curved slot 48 extending along an imaginary circle 47. The imaginary circle 47 has a center point which is the same as a rotation axis 55 of the vane rotor 30. The first stopper surface 43 is a first end surface of the curved slot 48 in the circumferential direction, and the second stopper surface 45 is a second end surface of the curved slot 48 in the circumferential direction. The first stopper surface 43 is the advance-side end surface of the curved slot 48, and the second stopper surface 45 is the retard-side end surface of the curved slot 48. Each of the first stopper surface 43 and the second stopper surface 45 is a concaved-curve surface which is able to contact the first end part of the stopper pin 42 in the circumferential direction.

As shown in FIG. 5, the sprocket 11 has a curved slot 49 extending along the imaginary circle 47. The imaginary circle 47 has the center point which is the same as the rotation axis 55 of the vane rotor 30. The first stopper surface 44 is a first end surface of the curved slot 49 in the circumferential direction, and the second stopper surface 46 is a second end surface of the curved slot 49 in the circumferential direction. The first stopper surface 44 is the advance-side end surface of the curved slot 49, and the second stopper surface 46 is the retard-side end surface of the curved slot 49. Each of the first stopper surface 44 and the second stopper surface 46 is a concaved-curve surface which is able to contact the second end part of the stopper pin 42 in the circumferential direction.

The stopper pin 41, the sprocket 11, and the cup 20 are made of metal, and the hardness is increased, for example, by a heat treatment such as hardening. Moreover, a surface treatment is performed to an outer surface of the stopper pin 41 and an inner surface of the curved slot 48, 49 so as to raise the wear resistance. The stopper pin 42 and the curved slot 48, 49 may correspond to a bearing portion which supports the vane rotor 30, when the vane rotor 30 has a relative rotation relative to the sprocket 11 and the cup 20.

Figure 6:
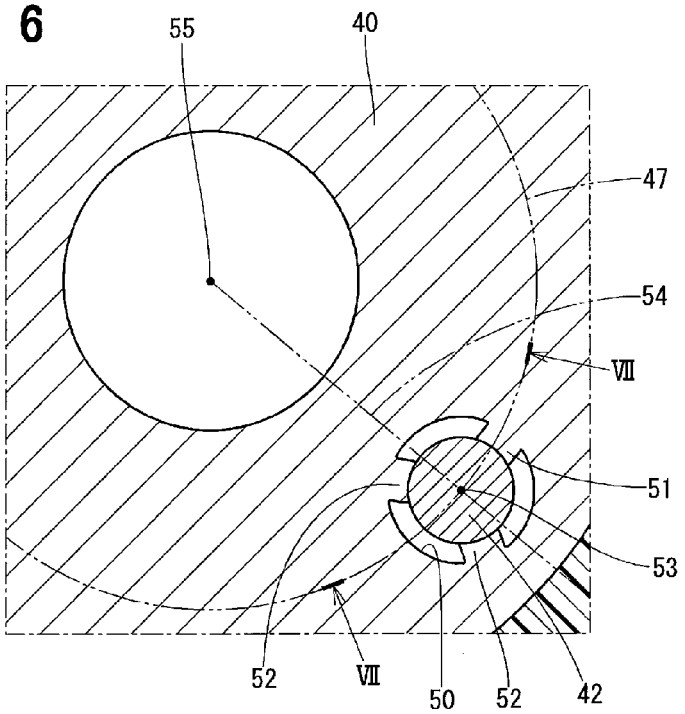
FIG. 6 is an enlarged cross-sectional view illustrating a stopper pin of the valve timing controller of FIG. 1.
Figure 7:
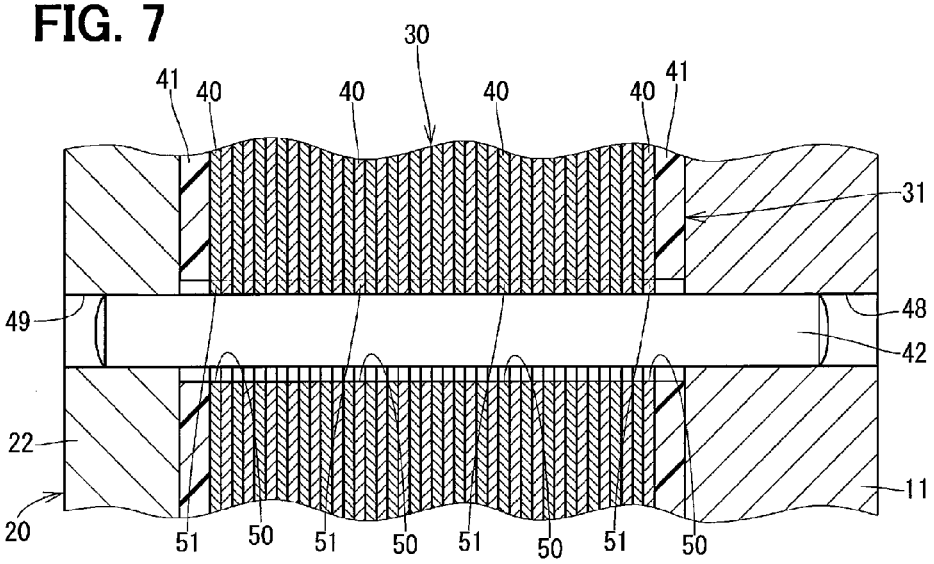
FIG. 7 is a cross-sectional view taken along a line VII-VII in FIG. 6.

As shown in FIG. 6 and FIG. 7, the metal plate 40 has a hole 50 in which the stopper pin 42 is inserted, and nails 51, 52 projected from the inner wall of the hole 50 toward the stopper pin 42, so as to hold the stopper pin 42. The metal plate 40 may correspond to a first metal plate. In the first embodiment, all the metal plates 40, which construct a lamination object, have the nails 51, 52.

When an imaginary straight line 54 is defined to pass the rotation axis 55 of the vane rotor 30 and a center axis 53 of the stopper pin 42, the nail 51 is located on the retard side with respect to the imaginary straight line 54, and may correspond to a retard side nail. The nail 52 is located on the advance side with respect to the imaginary straight line 54, and may correspond to an advance side nail.

As shown in FIG. 6, the one nail 51 and the two nails 52 are asymmetrically formed with respect to the imaginary straight line 54. Specifically, the nail 51 is positioned on the imaginary circle 47 which has the same center axis as the vane rotor 30 and which passes the center axis 53 of the stopper pin 42. The nail 52 is positioned on both sides with respect to the imaginary circle 47. The nails 51, 52 are located to have equal interval in the circumferential direction. The stopper pin 42 is held by the one nail 51 and the two nails 52, at three positions, in the circumferential direction.

In a case where the oil pressure of the oil pressure chamber is comparatively low, for example, immediately after the engine start, if the vane rotor 30 has an abnormal movement due to the variation torque transmitted from the camshaft to the vane rotor 30, the stopper pin 42 may collide against the second stopper surface 45, 46. At this time, the one nail 51 is elastically deformed in the axial direction, and absorbs the impulse force produced by the collision, and the two nails 52 follow the stopper pin 42 moving in accordance with the deformation of the nail 51 so as to maintain the holding state of the stopper pin 42.

According to the first embodiment, the valve timing controller 10 is equipped with the stopper pin 42 projected in the axial direction from the boss part 31 of the vane rotor 30. The stopper pin 42 regulates the relative rotation position of the vane rotor 30 at the maximum advance position by contacting the first stopper surface 43 of the sprocket 11 and the first stopper surface 44 of the bottom part 22 of the cup 20. The stopper pin 42 regulates the relative rotation position of the vane rotor 30 at the maximum retard position by contacting the second stopper surface 45 of the sprocket 11 and the second stopper surface 46 of the bottom part 22 of the cup 20.

The boss part 31 of the vane rotor 30 includes the plural metal plates 40 laminated in the axial direction. The metal plate 40 has the hole 50 in which the stopper pin 42 is inserted, and the nails 51, 52 projected toward the stopper pin 42 from the inner wall of the hole 50 so as to hold the stopper pin 42.

According to the valve timing controller 10, the impulse force produced when the stopper pin 42 collides with the stopper surface 43, 44, 45, 46 is eased by the elastic deformation of the nails 51, 52 of the metal plate 40. That is, the nails 51, 52 correspond to an impact-absorbing portion. Accordingly, the impulse force applied to the vane rotor 30, the sprocket 11 and the cup 20 can be reduced, and the vane rotor 30, the sprocket 11 and the cup 20 can be restricted from being damaged.

Moreover, the nail 51 located on the retard side and the nails 52 located on the advance side are asymmetrically formed with respect to the imaginary straight line 54.

Therefore, in case where the force applied to the vane rotor 30 from the stopper pin 42 in the circumferential direction is different between the retard side and the advance side, the nail 51 can be designed according to the retard-side force, and the nail 52 can be designed according to the advance-side force.

Moreover, the nail 51 is positioned on the imaginary circle 47.

Therefore, the nail 51 can receive the retard-side force applied to the vane rotor 30 from the stopper pin 42 on the line of action of the force.

Moreover, the nails 52 are formed on the respective sides with respect to the imaginary circle 47.

Therefore, the nail 52 can easily follow the stopper pin 42 which moves in accordance with the elastic deformation of the nail 51. Thus, even in the case where the stopper pin 42 moves, the holding state of the stopper pin 42 by the nail 52 is maintained.

Moreover, all the metal plates 40, which construct a lamination object, have the nails 51, 52.

Therefore, the acceptable value of the force received by the nails 51, 52 from the stopper pin 42 can be set higher, compared with a case where the nail is formed not all the plural metal plates which construct a lamination object.

Second Embodiment

Figure 8:
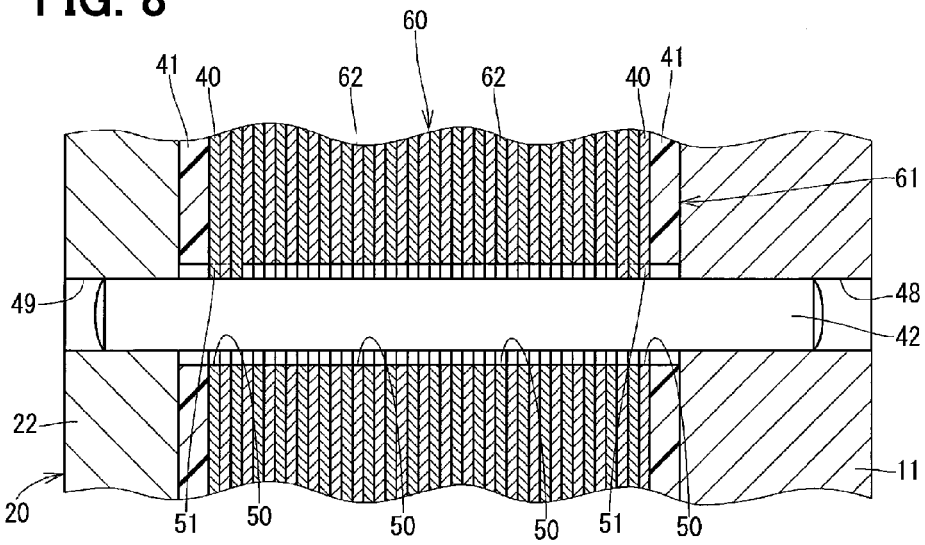
FIG. 8 is a circumferential cross-sectional view taken along a line passing a stopper pin of a valve timing controller according to a second embodiment, so as to correspond to FIG. 7 of the first embodiment.

The valve timing controller according to the second embodiment is explained with reference to FIG. 8.

In the second embodiment, the center section of the boss part 61 of the vane rotor 60 has plural metal plates 40 and plural metal plates 62. The metal plate 40 has the hole 50 and the nails 51, 52. The metal plate 62 has only the hole 50. The metal plate 62 may correspond to a second metal plate. As shown in FIG. 8, the metal plates 62 are located in the central portion of the boss part 61 of the vane rotor 60 in the axial direction, and the metal plate 40 is located at a first end part and a second end part of the boss part 61 of the vane rotor 60 in the axial direction. In other words, some of the metal plates 40 are interposed between the cup 20 and the metal plates 62 in the axial direction, and the other of the metal plates 40 are interposed between the metal plates 62 and the sprocket 11 in the axial direction.

According to the second embodiment, the number of the nails 51, 52 which receive the force applied to the vane rotor 60 from the stopper pin 42 is reduced, compared with the first embodiment. Thus, the impact absorption degree of the nails 51, 52 can be easily changed by adjusting the number of the nails 51, 52 according to the specification of the engine.

Third Embodiment

Figure 9:
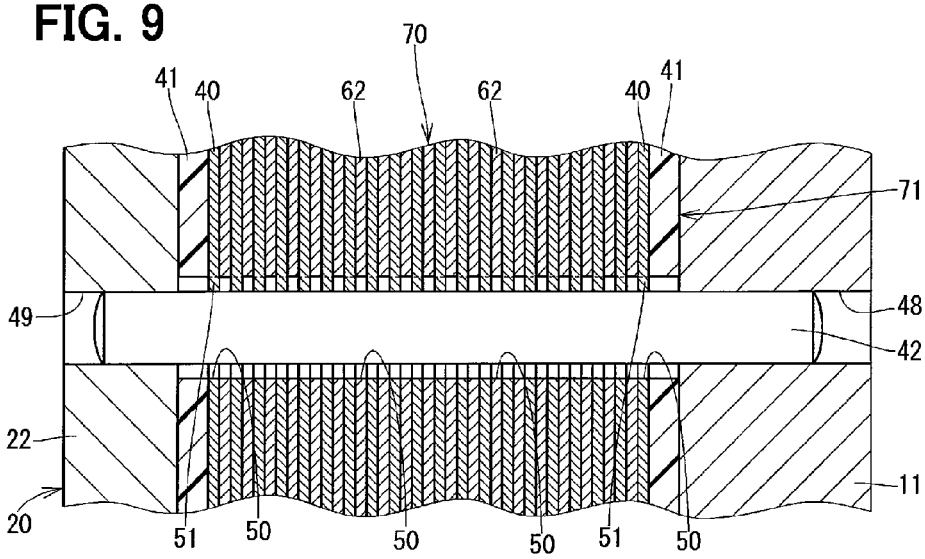
FIG. 9 is a circumferential cross-sectional view taken along a line passing a stopper pin of a valve timing controller according to a third embodiment, so as to correspond to FIG. 7 of the first embodiment.

The valve timing controller according to the third embodiment is explained with reference to FIG. 9.

In the third embodiment, the center section of the boss part 71 of the vane rotor 70 has plural metal plates 40 and plural metal plates 62. The metal plate 40 and the metal plate 62 are alternately laminated in the axial direction.

According to the third embodiment, the number of the nails 51, 52 which receive the force applied to the vane rotor 60 from the stopper pin 42 is reduced, compared with the first embodiment. Thus, the impact absorption degree of the nails 51, 52 can be easily changed by adjusting the number of the nails 51, 52 according to the specification of the engine.

Fourth Embodiment

Figure 10:
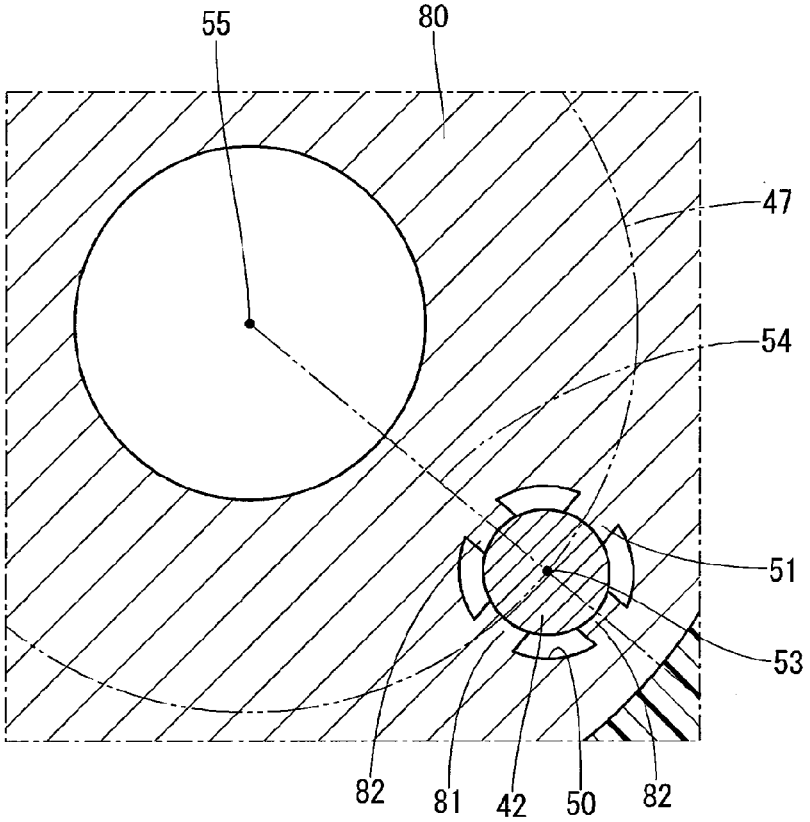
FIG. 10 is an enlarged cross-sectional view illustrating a stopper pin of a valve timing controller according to a fourth embodiment, so as to correspond to FIG. 6 of the first embodiment.

The valve timing controller according to the fourth embodiment is explained with reference to FIG. 10.

In the fourth embodiment, the metal plate 80 has a nail 51, a nail 81, and nails 82. The metal plate 80 may correspond to a first metal plate.

The nail 81 is an advance side nail located on the advance side with respect to the imaginary straight line 54, and is positioned on the imaginary circle 47. The nail 51 and the nail 81 are symmetrically formed with respect to the imaginary straight line 54. Two of the nails 82 are positioned on the imaginary straight line 54. The stopper pin 42 is held by the nail 51, the nail 81, and the two of the nails 82, at four positions, in the circumferential direction.

According to the fourth embodiment, the nail 81 can receive the advance side force applied to the vane rotor 30 from the stopper pin 42 on the line of action of the force.

Fifth Embodiment

Figure 11:
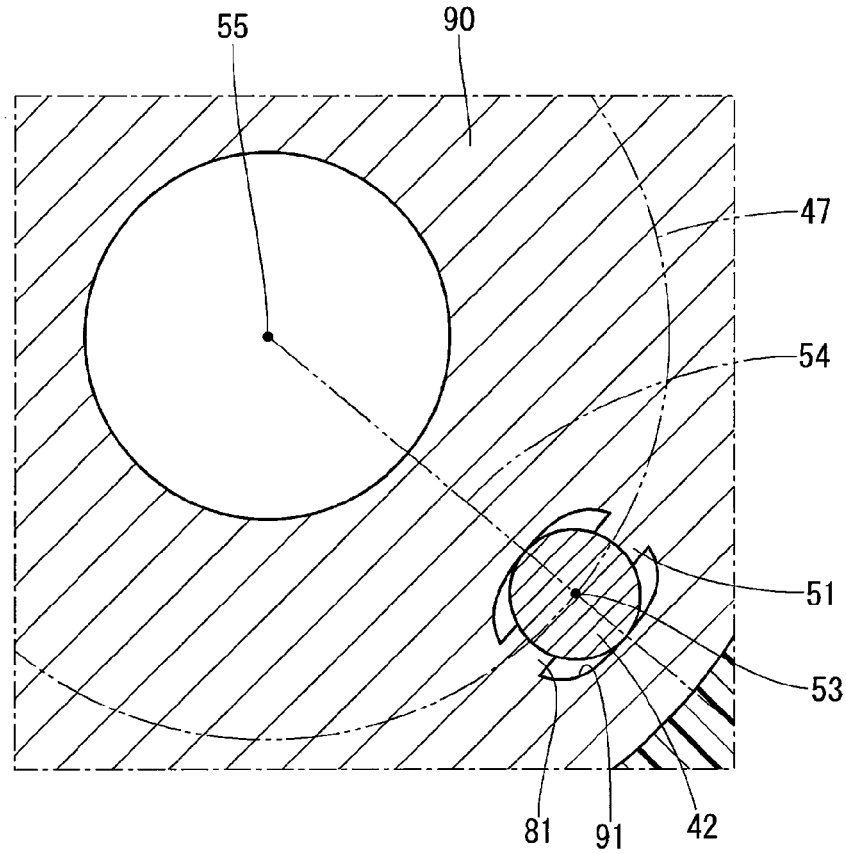
FIG. 11 is an enlarged cross-sectional view illustrating a stopper pin of a valve timing controller according to a fifth embodiment, so as to correspond to FIG. 6 of the first embodiment.

The valve timing controller according to the fifth embodiment is explained with reference to FIG. 11.

In the fifth embodiment, a metal plate 90 has a hole 91, a nail 51 and a nail 81. The metal plate 90 may correspond to a first metal plate.

The hole 91 has a comparatively long ellipse shape extending along the imaginary circle 47. In other words, a longitudinal direction of the hole 91 is in alignment with a circumferential direction of the imaginary circle 47. The stopper pin 42 is supported by an inner wall surface of the hole 91 at two positions which are positioned on the imaginary straight line 54. The stopper pin 42 is held by the nail 51 and the nail 81 at two positions in the circumferential direction.

According to the fifth embodiment, the shape of the metal plate 90 can be simplified because the nails 82 are eliminated compared with the fourth embodiment.

Sixth Embodiment

Figure 12:
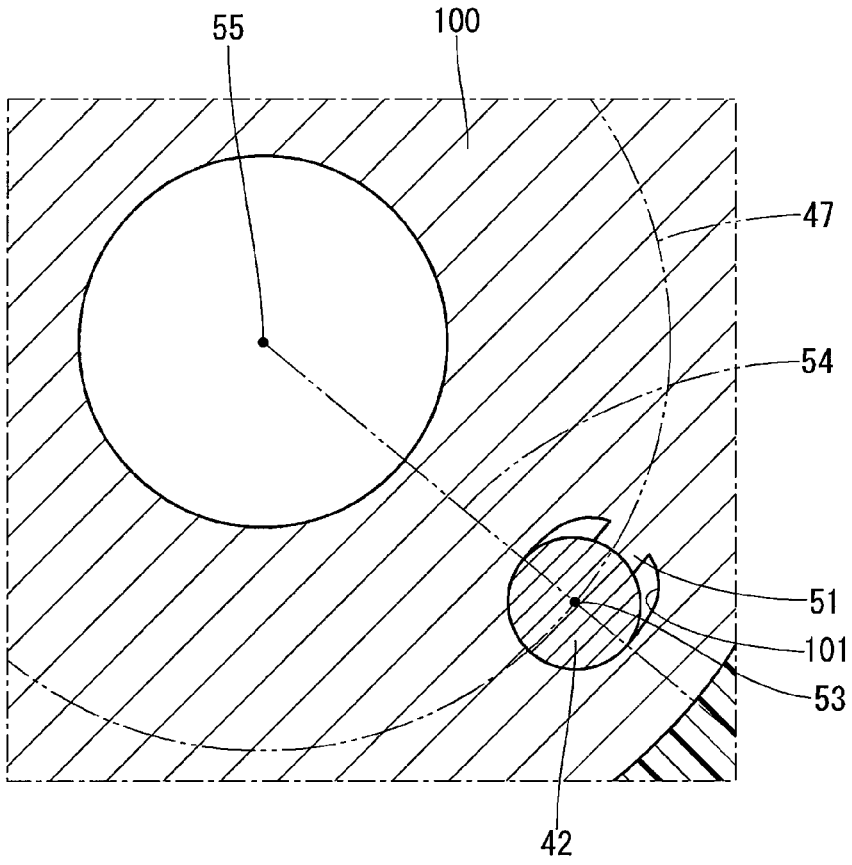
FIG. 12 is an enlarged cross-sectional view illustrating a stopper pin of a valve timing controller according to a sixth embodiment, so as to correspond to FIG. 6 of the first embodiment.

The valve timing controller according to the sixth embodiment is explained with reference to FIG. 12.

In the sixth embodiment, a metal plate 100 has a hole 101 and a nail 51. The metal plate 100 may correspond to a first metal plate.

The hole 101 has a comparatively long ellipse shape extending along the imaginary circle 47. In other words, a longitudinal direction of the hole 101 is in alignment with a circumferential direction of the imaginary circle 47. The stopper pin 42 is supported by an inner wall surface of the hole 101 on the advance side with respect to the imaginary straight line 54. The stopper pin 42 is held by the nail 51 at one position in the circumferential direction.

According to the sixth embodiment, the shape of the metal plate 100 can be simplified because the nail 81 and the nails 82 are eliminated compared with the fourth embodiment.

Seventh Embodiment

Figure 13:
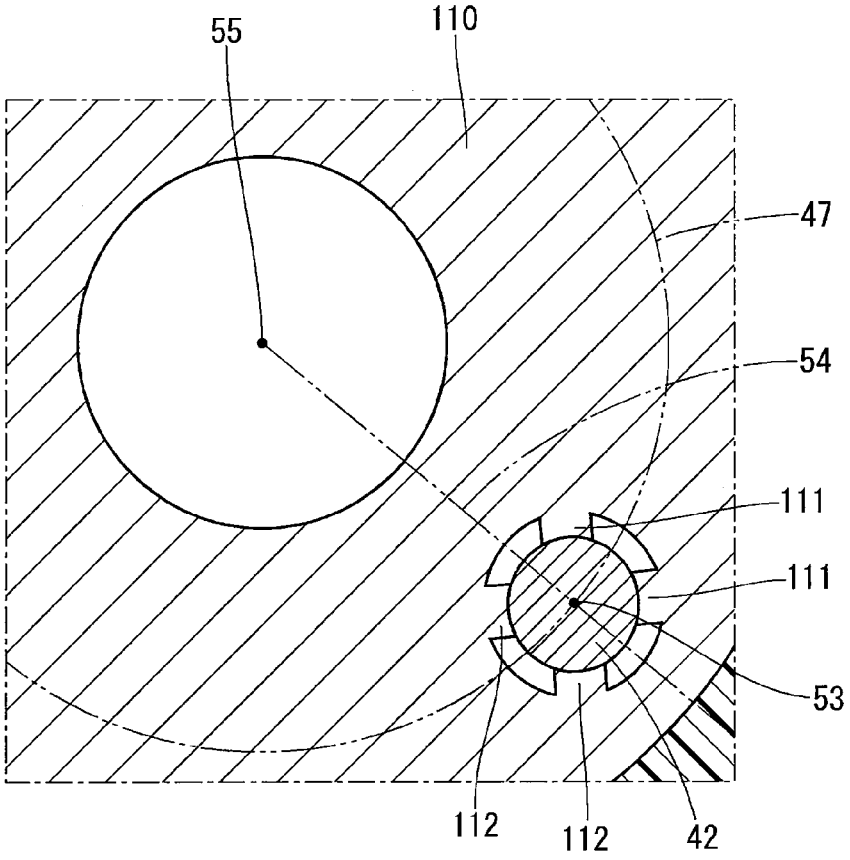
FIG. 13 is an enlarged cross-sectional view illustrating a stopper pin of a valve timing controller according to a seventh embodiment, so as to correspond to FIG. 6 of the first embodiment.

The valve timing controller according to the seventh embodiment is explained with reference to FIG. 13.

In the seventh embodiment, a metal plate 110 has two nails 111 and two nails 112. The metal plate 110 may correspond to a first metal plate.

The nails 111 are retard side nails located on the retard side with respect to the imaginary straight line 54, and are positioned on respective sides with respect to the imaginary circle 47. The nails 112 are advance side nails located on the advance side with respect to the imaginary straight line 54, and are positioned on respective sides with respect to the imaginary circle 47.

According to the seventh embodiment, the nails 111 are comparatively easily bent because the nails 111 receive the retard side force applied to the vane rotor 30 from the stopper pin 42 at positions distanced from the line of action of the force. Thus, the impact absorption degree of the nails 111 can be easily changed by adjusting the positions of the nails 111 according to the specification of the engine.

Eighth Embodiment

Figure 14:
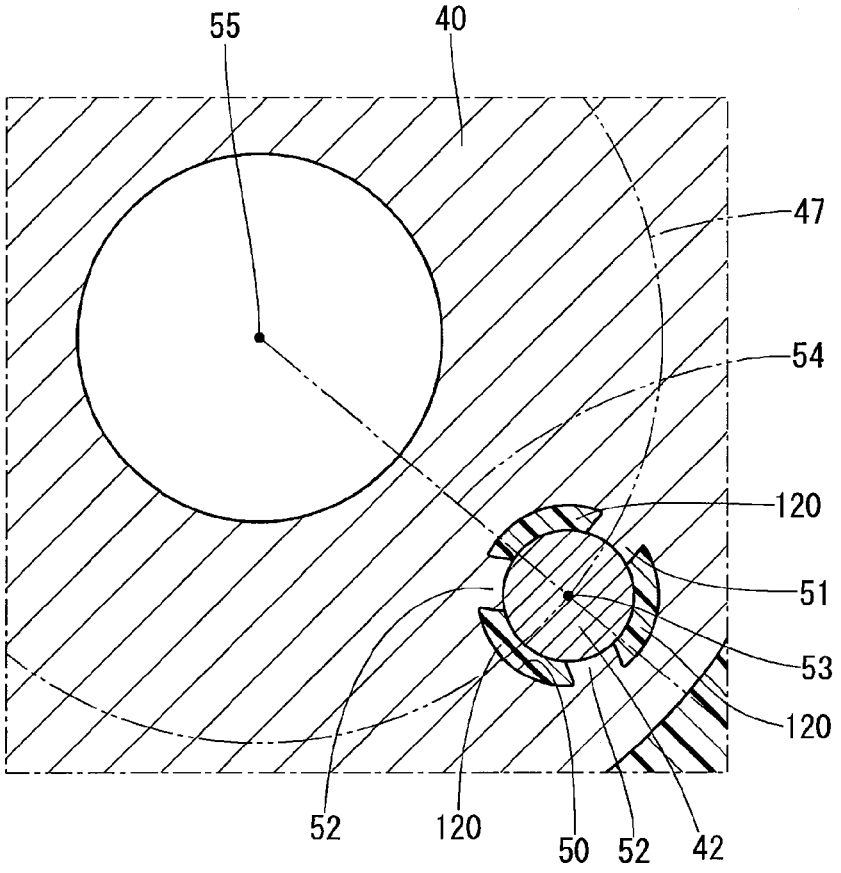
FIG. 14 is an enlarged cross-sectional view illustrating a stopper pin of a valve timing controller according to an eighth embodiment, so as to correspond to FIG. 6 of the first embodiment.

The valve timing controller according to the eighth embodiment is explained with reference to FIG. 14.

In the eighth embodiment, the hole 50 of the metal plate 40 is filled with an elastic component 120. In other words, the elastic component 120 is fittingly disposed in the hole 50 in the sealed state.

Therefore, the force applied to the vane rotor 30 from the stopper pin 42 can be received by the elastic component 120. Thus, the impact absorption degree can be easily controlled by the elastic component 120 according to the specification of the engine.

Ninth Embodiment

Figure 15:
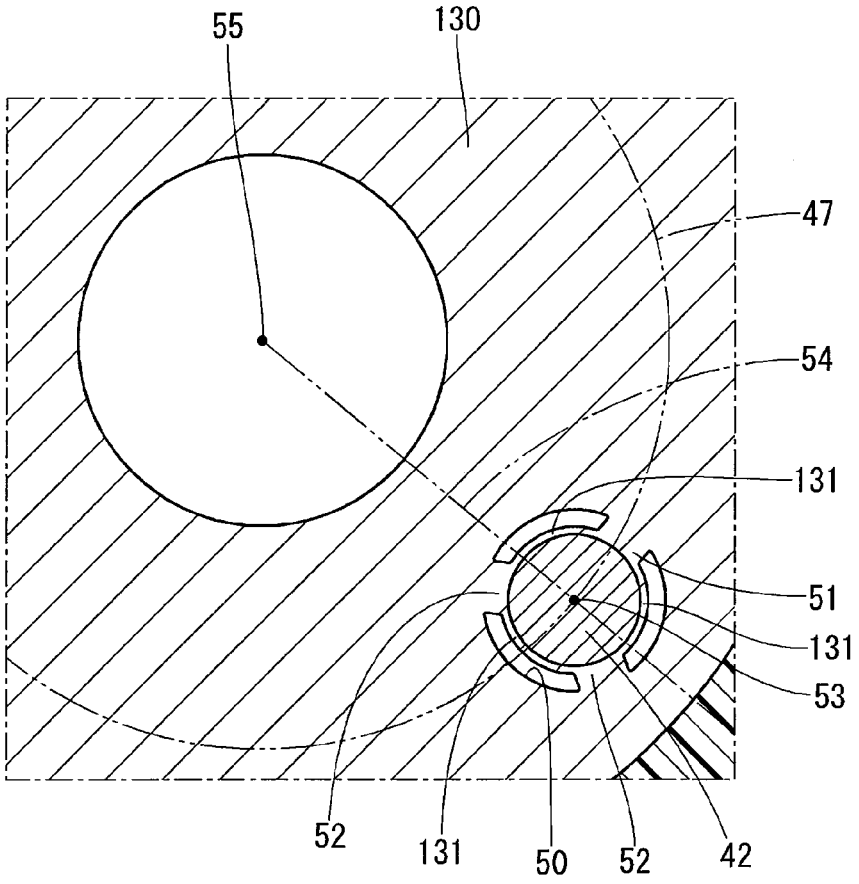
FIG. 15 is an enlarged cross-sectional view illustrating a stopper pin of a valve timing controller according to a ninth embodiment, so as to correspond to FIG. 6 of the first embodiment.

The valve timing controller according to the ninth embodiment is explained with reference to FIG. 15.

In the ninth embodiment, a tip end part of the nail 51 of the metal plate 130 and a tip end part of the nail 52 of the metal plate 130 are connected to each other by a connector 131. The connector 131 circularly extends along the outer periphery surface of the stopper pin 42, and defines a circular inner wall surface which is in tightly contact with the outer periphery surface of the stopper pin 42 together with the tip end part of the nail 51 and the tip end part of the nail 52.

According to the ninth embodiment, the positioning of the stopper pin 42 can be easily performed at the time of attachment.

Tenth Embodiment

Figure 16:
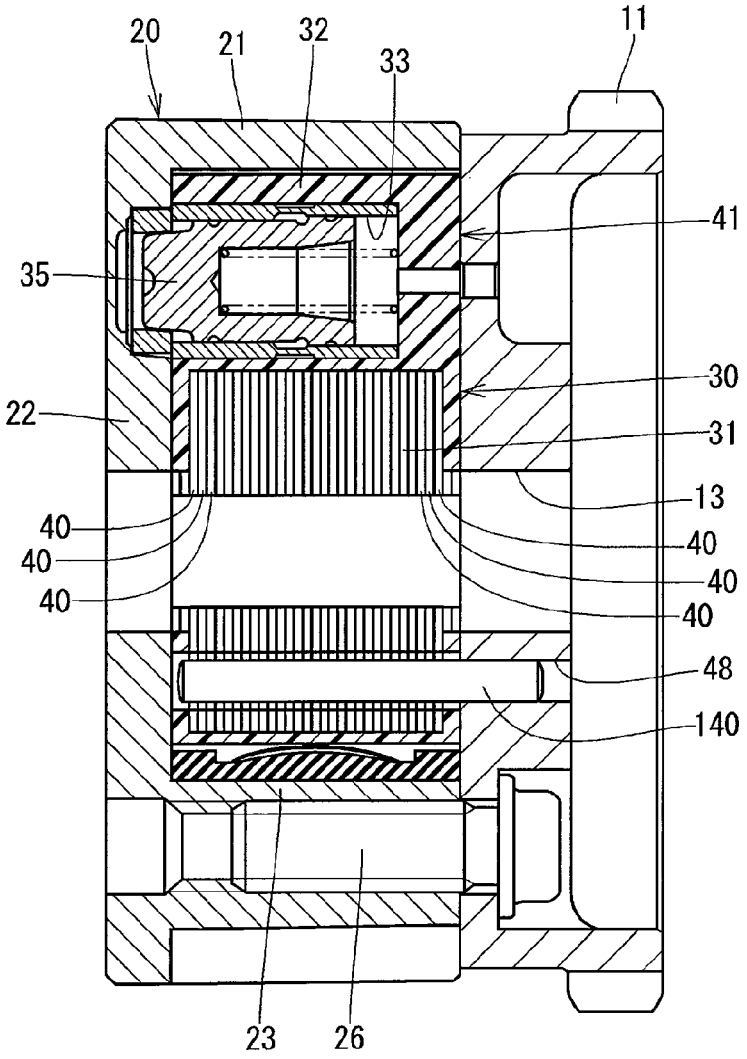
FIG. 16 is a cross-sectional view illustrating a valve timing controller according to a tenth embodiment, so as to correspond to FIG. 3 of the first embodiment.

The valve timing controller according to the tenth embodiment is explained with reference to FIG. 16.

In the tenth embodiment, only one end part of the stopper pin 140 adjacent to the sprocket 11 is projected from the boss part 31 of the vane rotor 30. That is, the other end part of the stopper pin 140 adjacent to the bottom part 22 of the cup 20 is not projected from the boss part 31 of the vane rotor 30. The one end part of the stopper pin 140 is able to contact with the first stopper surface 43 and the second stopper surface 45 of the sprocket 11.

Similarly to the first embodiment, when the stopper pin 140 contacts the stopper surface 43, 45, the nails of the metal plates 40 which support the stopper pin 140 are elastically bent, therefore the impulse force transmitted from the stopper pin 140 to the vane rotor 30 is reduced. Therefore, the metal plates 40 can be restricted from being damaged when the impulse force is applied.

Eleventh Embodiment

Figure 17:
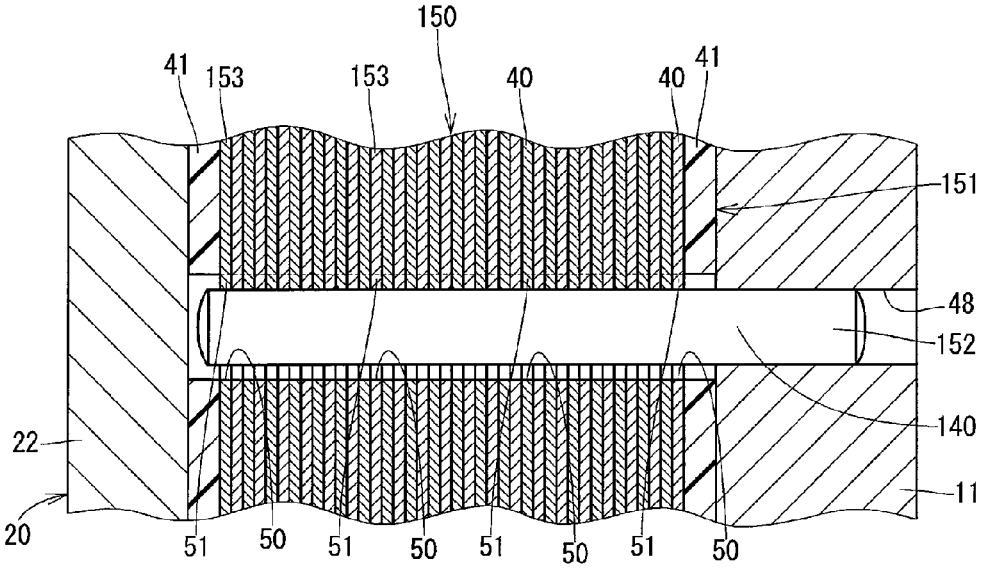
FIG. 17 is a circumferential cross-sectional view taken along a line passing a stopper pin of a valve timing controller according to an eleventh embodiment, so as to correspond to FIG. 7 of the first embodiment.

The valve timing controller according to the eleventh embodiment is explained with reference to FIG. 17.

In the eleventh embodiment, the one end part of the stopper pin 140 projected out of the vane rotor 150 is defined as a projection portion 152. The boss part 151 of the vane rotor 150 has plural metal plates 40 and plural metal plates 153. The metal plates 153 are located far from the projection portion 152 than the metal plates 40 are. The metal plates 153 are made of a material which has Young's modulus lower than that of the metal plates 40. For example, the metal plate 40 is made of steel and the metal plate 153 is made of aluminum alloy.

When the stopper pin 140 contacts the second stopper surface, the force applied to the metal plate 153 is smaller than the force applied to the metal plate 40. Therefore, in a comparison case where the material is the same for all the metal plates, the bending amount of the nail of the metal plate will be greatly different depending on the position from the projection portion 152.

In contrast, according to the eleventh embodiment, Young's modulus of the material of the metal plate 153 far from the projection portion 152 is lower than Young's modulus of the material of the metal plate 40 near the projection portion 152. Therefore, the variation in the bending amount of the nail 51 can be reduced between the metal plate 40 and the metal plate 153.

Other Embodiment

The vane rotor may be made of only metal plates without resin component. The number of the nails of the metal plate may be more than or equal to five. When the metal plate has plural nails, the nails may non-uniformly arranged around the stopper pin. The number of the stopper pins may be more than or equal to two. In this case, the stopper pins may be uniformly or non-uniformly arranged in the circumferential direction. The stopper pin may be prepared for each of the first end part and the second end part of the vane rotor in the axial direction. The stopper pin may be formed to project from the boss part of the vane rotor only at the end part adjacent to the bottom part of the cup.

The contact surface through which the stopper pin and the stopper surface contact with each other may not consist of a convex curve and a concave curve. For example, the contact surface of the stopper pin may consist of a flat plane and the contact surface of the stopper surface may consist of a flat plane. The stopper surface may not be made of the end surface of the curved slot in the circumferential direction, for example, may be an inner wall surface of a concave portion or an outer wall surface of a convex portion. A part or all of the stopper pin, the sprocket, and the cup may consist of a material, such as resin, other than metal. A surface treatment may not be performed to the stopper pin and the inner wall of the curved slot.

Heat treatment may not be performed to some or all of the stopper pin, the sprocket, and the cup. The bearing portion of the vane rotor may consist of other than the stopper pin and the curved slot. The number of the vane parts of the vane rotor may be four or more. The valve timing controller may control the opening-and-closing timing of an exhaust valve of the engine.

Such changes and modifications are to be understood as being within the scope of the present disclosure as defined by the appended claims.

What is claimed is:

1. A valve timing controller which controls opening-and-closing timing of a valve driven by a driven shaft by changing a rotation phase of the driven shaft to a driving shaft of an internal combustion engine, the valve timing controller comprising:

a housing which is rotatable integrally with one of the driving shaft and the driven shaft, the housing having a first stopper surface and a second stopper surface;

a vane rotor including a boss part which is rotatable integrally with the other of the driving shaft and the driven shaft inside the housing, and a vane part which divides a space partitioned by the housing and the boss part into an advance chamber and a retard chamber, the vane rotor relatively rotating relative to the housing on an advance side or a retard side according to a pressure of oil in the advance chamber and the retard chamber; and a stopper pin projected from the boss part of the vane rotor to the housing in an axial direction, the stopper pin regulating a relative rotation position of the vane rotor to the housing to a maximum advance position by contacting the first stopper surface of the housing, the stopper pin regulating the relative rotation position of the vane rotor to the housing to a maximum retard position by contacting the second stopper surface of the housing, wherein;

the boss part of the vane rotor has a plurality of metal plates layered with each other in the axial direction, at least one metal plate of the plurality of metal plates has a hole in which the stopper pin is inserted, and a nail projected from an inner wall of the hole toward the stopper pin so as to hold the stopper pin, and the at least one metal plate having both the hole and the nail is a first metal plate, and the other of the plurality of metal plates is a second metal plate having only the hole in which the stopper pin is inserted.

2. The valve timing controller according to claim 1, wherein the second metal plate is located at a central portion of the boss part of the vane rotor in the axial direction, and the first metal plate is located at a first end portion and a second end portion of the boss part of the vane rotor in the axial direction.

3. The valve timing controller according to claim 1, wherein the first metal plate and the second metal plate are alternately layered in the axial direction.

4. The valve timing controller according to claim 1, wherein the nail is one of a plurality of nails, and the first metal plate has the plurality of nails, an imaginary straight line is defined to pass a rotation axis of the vane rotor and a center axis of the stopper pin, the nail located on the advance side with respect to the imaginary straight line is defined as an advance side nail, the nail located on the retard side with respect to the imaginary straight line is defined as a retard side nail, and the advance side nail and the retard side nail are asymmetrically formed with respect to the imaginary straight line.

5. The valve timing controller according to claim 4, wherein an imaginary circle is defined to have a center point which is the same as the rotation axis of the vane rotor and to pass the center axis of the stopper pin, and the retard side nail is positioned on the imaginary circle.

6. The valve timing controller according to claim 5, wherein the advance side nail is positioned on respective sides with respect to the imaginary circle.

7. The valve timing controller according to claim 1, wherein the nail is one of a plurality of nails, and respective tip end parts of the plurality of nails are connected with each other by a connector.

8. A valve timing controller which controls opening-and-closing timing a valve driven by a driven shaft by changing a rotation phase of the driven shaft to a driving shaft of an internal combustion engine, the valve timing controller comprising:

a housing which is rotatable integrally with one of the driving shaft and the driven shaft, the housing having a first stopper surface and a second stopper surface;

a vane rotor including a boss part which is rotatable integrally with the other of the driving shaft and the driven shaft inside the housing, and a vane part which divides a space partitioned by the housing and the boss part into an advance chamber and a retard chamber, the vane rotor relatively rotating relative to the housing on an advance side or a retard side according to a pressure of oil in the advance chamber and the retard chamber; and a stopper pin projected from the boss part of the vane rotor to the housing in an axial direction, the stopper pin regulating a relative rotation position of the vane rotor to the housing to a maximum advance position by contacting the first stopper surface of the housing, the stopper pin regulating the relative rotation position of the vane rotor to the housing to a maximum retard position by contacting the second stopper surface of the housing, wherein:

the boss part of the vane rotor has a plurality of metal plates layered with each other in the axial direction, at least one metal plate of the plurality of metal plates has a hole in which the stopper pin is inserted, and a nail projected from an inner wall of the hole toward the stopper pin so as to hold the stopper pin, the stopper pin has a projection portion protruding out of the vane rotor, the plurality of metal plates has a far metal plate which is located far from the projection portion than a near metal plate is, and the far metal plate is made of a material having Young's modulus which is lower than Young's modulus of a material of the near metal plate.

9. A valve timing controller which controls opening-and-closing timing of a valve driven by a driven shaft by changing a rotation phase of the driven shaft to a driving shah of an internal combustion engine, the valve timing controller comprising:

a housing which is rotatable integrally with one of the driving shaft and the driven shaft, the housing having a first stopper surface and a second stopper surface;

a vane rotor including a boss part which is rotatable integrally with the other of the driving shaft and the driven shaft inside the housing, and a vane part which divides a space partitioned by the housing and the boss part into an advance chamber and retard chamber, the vane rotor relatively rotating relative to the housing on an advance side or a retard side according to a pressure of oil in the advance chamber and the retard chamber; and a stopper pin projected from the boss part of the vane rotor to the housing in an axial direction, the stopper pin regulating a relative rotation position of the vane rotor to the housing to aim maximum advance position by contacting the first stopper surface of the housing, the stopper pin regulating the relative rotation position of the vane rotor to the housing to a maximum retard position by contacting the second stopper surface of the housing, wherein:

the boss part of the vane rotor has a plurality of metal plates layered with each other in the axial direction, at least one metal plate of the plurality of metal plates has a hole in which the stopper pin is inserted, and a nail projected from an inner wall of the hole toward the stopper pin so as to hold the stopper pin, and the valve timing controller further comprises: an elastic component disposed in the hole.

* * * * *